United States Patent [19]

Petros

[11] Patent Number: 4,779,355

[45] Date of Patent: Oct. 25, 1988

[54] EFFICIENT DRYER AND DRYING PROCESS

[75] Inventor: Kenneth W. Petros, Tyngsborough, Mass.

[73] Assignee: Dec-E-Tech, Inc., Tyngsborough, Mass.

[21] Appl. No.: 109,219

[22] Filed: Oct. 15, 1987

Related U.S. Application Data

[63] Continuation-in-part of Ser. No. 937,820, Dec. 4, 1986, abandoned.

[51] Int. Cl.[4] ..... F26B 3/04

[52] U.S. Cl. ..... 34/23; 34/34; 34/155; 34/160

[58] Field of Search ..... 34/23, 34, 155, 156, 34/160, 241; 15/345, 346

*Primary Examiner*—Larry I. Schwartz

*Attorney, Agent, or Firm*—Andrew F. Kehoe

[57] ABSTRACT

Apparatus and process for drying coated surfaces, e.g. inked surfaces, with improved efficiency. The apparatus comprises an air-directing baffle which has vortex-inducing means, e.g. grooves or slots therein. The slots are arranged substantially perpendicular to the general direction of flow of drying gas through a drying zone formed by the baffle and the surface being dried. The vortices provide both (1) improved drying efficiency at the interface between coated surface and drying gas and (2) effective dissipation of kinetic energy from the drying gas as it traverses the drying zone. Less energy is required to exhaust spent drying gas from the drying zone while effectively preventing the gas from escaping into the environment. In dual-drier systems, fed by centrally located air nozzles, means is provided to avoid an asperating effect which tends to suck the web toward the apparatus. In systems to be used with flat webs and especially unsupported flat webs, the air directing baffle means are best made approximately parallel with said flat web.

26 Claims, 5 Drawing Sheets

FIG. 8
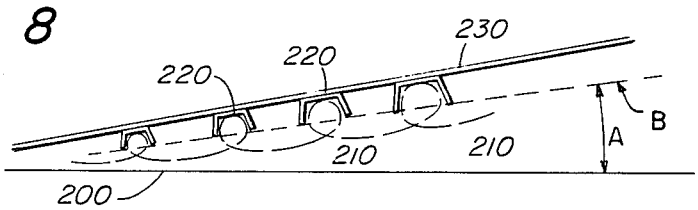
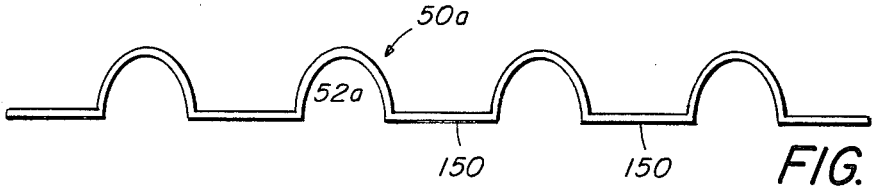
FIG. 3
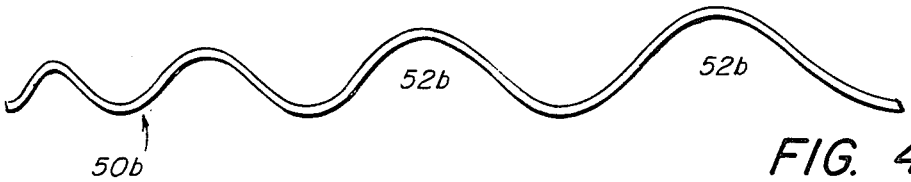
FIG. 4
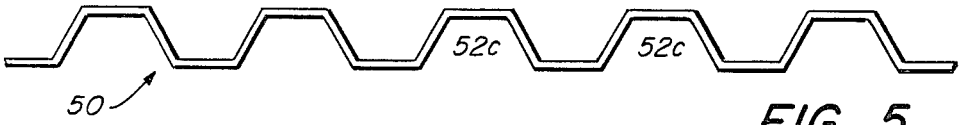
FIG. 5
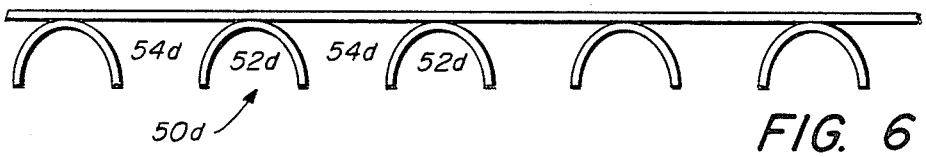
FIG. 6
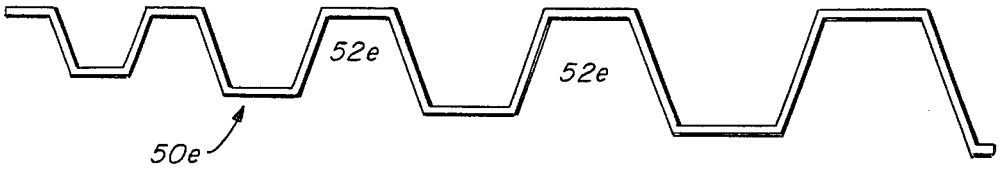
FIG. 7

EFFICIENT DRYER AND DRYING PROCESS

RELATED APPLICATION

This application is a continuation-in-part of co-pending and commonly-owned U.S. patent application Ser. No. 937,820 filed 12-4-86, now abandoned, entitled EFFICIENT DRYER AND DRYING APPARATUS by Kenneth W. Petros.

BACKGROUND OF THE INVENTION

This invention relates to apparatus for contacting surfaces with flowing gas, e.g. drying apparatus, particularly drying apparatus that provides means to supply drying gas to a surface to be dried and, then, provides means to remove the spent drying gas together with the moisture or solvents it has picked up, from the drying zone without allowing any substantial part of the spent gas to escape into the environment's proximate the site of the drying.

There are a large number of industrial drying processes wherein surfaces are coated with liquid-based compositions and wherein the liquid component of the composition must be removed immediately so that the process may be carried out at a commercially-suitable rate. Such processes require the use of large quantities of drying air continuously supplied to a drying zone.

Among such processes are those for drying printing inks to surfaces that are, typically, moving at hundreds of feet per minute. Other such processes are those wherein adhesives or other such functional coatings are being applied. The economics of such processes become particularly sensitive to the efficiency of the drying process when large quantities of solvents such as water must be removed and, especially, when expensive or noxious solvents must be removed upon drying. In such cases, it is necessary to provide a drying process wherein the spent drying gas (that is, the drying gas which has passed through the drying zone and picked up the volatile material being evaporated) is removed from the drying zone without escaping into the environment of the drying equipment. A substantial portion of the cost of such removal is the fuel for energy expended on driving exhaust fans.

Drying apparatus has been provided in the prior art which was intended to meet the general requirements of the process described above. In general, high-velocity drying air was sent, through a number of air tubes, into the drying zone and sufficient air outlet exhaust capacity was provided to remove the drying air, once spent, from the drying zone. In one example of the prior art, a jet of drying air was directed downwardly into the drying surface and thence deflected to form a vortex on each side of the jet before being exhausted. There are a number of problems with this earlier-existing equipment which may be summarized by reference to the fact that it was very expensive to provide the exhaust capacity to remove spent drying gas and, usually, this factor played an important role in limiting the overall operational efficiency of the drying process. For example, the speed of the drying process itself would often be limited to allow the existing exhaust system to achieve its purpose.

Attempts have been made to increase velocity, and volume of drying gas at the surface to be dried; the associated increases in equipment cost, cost of operating the equipment, and the increased difficulty of collecting spent gases, have made such slower operating rates generally acceptable practice.

Another drawback to prior art drying apparatus, and like gas-handling apparatus, is the disproportionate amount of space adjacent the surface to be dried which is taken up by structure associated with merely handling incoming and/or outgoing gas relative to the amount of space which is available for effective drying.

The present inventor directed his efforts to improving such gas-handling processes.

SUMMARY OF INVENTION

It is a principal object of the present invention to provide improved drying apparatus of the type which comprises a gas drier brought into proximity to, but not necessarily in sealing contact with, a surface to be dried.

Another object of the invention is to provide gas-treating apparatus which is characterized by its ability to contain exhaust in large volumes of process gas with relatively small energy expenditures.

Another object of the invention is to provide a drying apparatus having improved means to mix and to dissipate kinetic energy of the drying gas within a drying zone, improving the efficiency of said drying process.

It is an object of the invention to have an improved proportion of effective drying area within a relatively compact apparatus.

A further object of the invention is to provide apparatus with a short multiple-vortex-inducing path through the drying zone.

It is a further object to achieve the above objects using a centrally-fed dual-nozzle device with two drier units on either side of the dual nozzle structure.

It is another object of the invention to provide a device which substantially achieves the objects of the invention when the web is flat and unsupported.

Other objectives of the invention are to provide superior drying and gas-containing processes utilizing vortex-inducing of drying gas within a drying zone.

Other objects of the invention will be obvious to those skilled in the art on their reading of this disclosure.

Although emphasis in this disclosure is placed on drying apparatus and processes, it should also be understood that the apparatus and gas-manipulating processes of the invention can be applied to other gas treating processes including, for example, such processes as applying hot air to a surface in order to achieve a chemical cure (e.g. curing organic resin coatings such as epoxy resin and polyurethane resin coating systems) and such processes as applying chemical-reactant bearing gases to take part in deposition of a C.V.D. (chemical-vapor-deposition) coating on the surface of a material being processed: Consequently, in the broadest sense, the invention is to be considered to relate to a process for applying process gas to a surface and to apparatus which is particularly useful in such a process.

The above objects have been accomplished by providing apparatus that comprises a baffle means for forming a series of vortices in the process gas as it moves through the drying zone formed by the baffle and the surface to be dried.

Applicant has provided an apparatus of the type used to provide process gas across a surface to be treated with the gas, wherein there is a flow-directing baffle along the lower perimeter of the apparatus and an elongate inlet conduit means at a side of the baffle to introduce a stream of high velocity gas between the flow-directing baffle and the surface to be treated. The flow-directing baffle comprises a series of primary grooves therein, these primary grooves being arranged generally perpendicular to the general direction of flow of the process gas from the elongate conduit across the surface to be dried or otherwise treated. A series of primary grooves form means, when the apparatus is brought into close proximity with a surface to be treated, to form a series of vortices in the process gas as it transverses across said surface in a process zone formed betwen the surface and the flow-directing baffle. Suction means is provided to remove spent process gas from said apparatus. The suction means is conveniently incorporated into a common housing with the elongate conduit means. Each of the primary grooves is positioned at an incrementally greater vertical distance from said elongate inlet conduit as it is positioned incremently further from the elongated conduit along the flow-directing baffle. The apparatus usually comprises from two to eight primary grooves along the baffle, but four or more are most advantageous.

The drying gas is initially directed from the inlet slot against the wet surface to be dried and thence deflected upwardly against the flow-directing baffle. Velocity of the drying gas across the drying zone is decreased by about an order of magnitude before leaving the drying zone. Preferably the gas moves across the drying zone counter-current to movement of the surface being dried. Diffusion of the gas between the inlet slot and the relatively wide end of the drying zone is achieved by an increase in the cross section of the zone, betwen the inlet slot and the wide end, being defined by an angle of between 8 and 15 angular degrees between a tangent line drawn along the bottom of circles inscribed in the cross section of the grooves and the surface to be dried, the baffle and the surface to be dried.

It will be understood that the average velocity of a given volume of spent drying gas leaving the drying zone, ignoring the relatively small velocity component assignable to the pick-up of volatiles and any temperature drop, is largely assignable to the ratio of cross sections between inlet and outlet conduits. However, applicant has demonstrated that the average velocity of gas leaving the drying zone is but one among several features which are important in achieving efficient removal of drying gas, that it is also important, to increase the overall efficiency of drying and handling of the drying gas, and to reduce the maximum velocity components of any portion of the spent drying gas. The mixing action facilitated by the grooved baffle surface facilitates the dissipating of kinetic energy which is then no longer available to maintain high-velocity transients of the spent gas stream.

After practical inlet-gas velocity limits are reached, management of the high velocity air within the drying zone determines drying efficiency. As demonstrated by the present invention, the particular way the air is processed can maximize air velocity and air vector profiles to provide a highly efficient gas-treating process and apparatus.

It has been found that properly aligned and spaced vortex-inducing grooves can facilitate vortex action of the gas in the drying zone such that undesirable localized drag effects at the drying surfaces are overcome. Instead, relatively high velocity vectors of drying gas are achieved at the surface being dried. The vortices provide improved gas velocity and mixing action which allow substantially higher rates of evaporation from the surface being dried. Thus the invention at once achieves not only the relatively inexpensive and easy removal of spent process gas, as the gas leaves the drier, it also achieves a more efficient contact of gas with the surface being processed as the gas passes through the equipment.

For convenience, the invention is described with respect to an apparatus with process gas coming into it at the side and moving in a generally-horizontal direction beneath the apparatus and above a surface being processed, e.g. being dried. It should be understood that there is no reason to restrict the operation of such a device to orientation in any particular plane. Indeed, in practice, the compact design of the apparatus facilitates the stationing of a number of such stations around a single flexographic roll, each positioned at a different angle with respect to the other.

Moreover, although it is convenient to describe the air as coming in along the side of each baffle, it should be understood that there could be two or more such baffles in a single housing and that air could come in, from a position above the baffle and be distributed laterally beneath a plurality of vortex-forming baffles on either side of the inlet air conduit. Of course this would simply be a case of utilizing two of the drying elements of the invention.

At times it is desirable to use two driers as described herein, each of which is fed through an air supply means centrally located to the two driers. In such a case, it has been found that many webs, particularly, non-supported webs, have a tendency to rise at a point centered between the two driers. The problem with such a rise is that it may interfere with the drying process and even may cause the web to rub against the drier equipment or limit the proximity of the placement of the drying apparatus to the web. It has been found that this centrally-located rising web phenomena can be overcome by providing a shield proximate the orifice to restrict the initial flow of drying gas to the drying zone. This is conveniently, and advantageously, achieved by extending the wall of one vortex-inducing channel in each drier, i.e. the wall nearest to the inlet nozzle to restrict flow to the drying zone and thereby tend to avoid excessive pressure drops in the space above the web and between the two nozzles.

Another problem that sometimes arises in drying operations with the apparatus as depicted in FIGS. 1 through 8 is that, when the drier is used with flat webs, there is a tendency for the web to lift up as it traverses beneath the apparatus near the gas-exit ports where the pressure of the drying gas apparatus is usually relatively low when the apparatus is used as is shown in claims 1 through 8. It has been found that this problem can be solved by markedly reducing the angle between the vortex-inducing structure and the substrate. The angle can be reduced to substantially zero, e.g. wherein the flat substrate is substantially parallel to a tangent line along of the bottom of the vortex-inducing grooves.

ILLUSTRATIVE EMBODIMENT OF THE INVENTION

In this application there is described a preferred embodiment of the invention and suggested various alternatives and modifications thereof, but it is to be understood that these are not intended to be exhaustive and that other changes and modifications can be made within the scope of the invention. These suggestions herein are selected and included for the purposes of illustration in order that others skilled in the art will more fully understand the invention and the principles thereof and will be able to modify it and embody it in a variety of forms, each as may be best suited to the condition of a particular case.

IN THE DRAWINGS

FIGS. 3, 4, 5, 6, and 7 illustrate other vortex-inducing baffle plate configurations.

FIG. 8 is a schematic drawing indicating the angle between the bottom of the drying apparatus and the material being dried.

Figure 9:
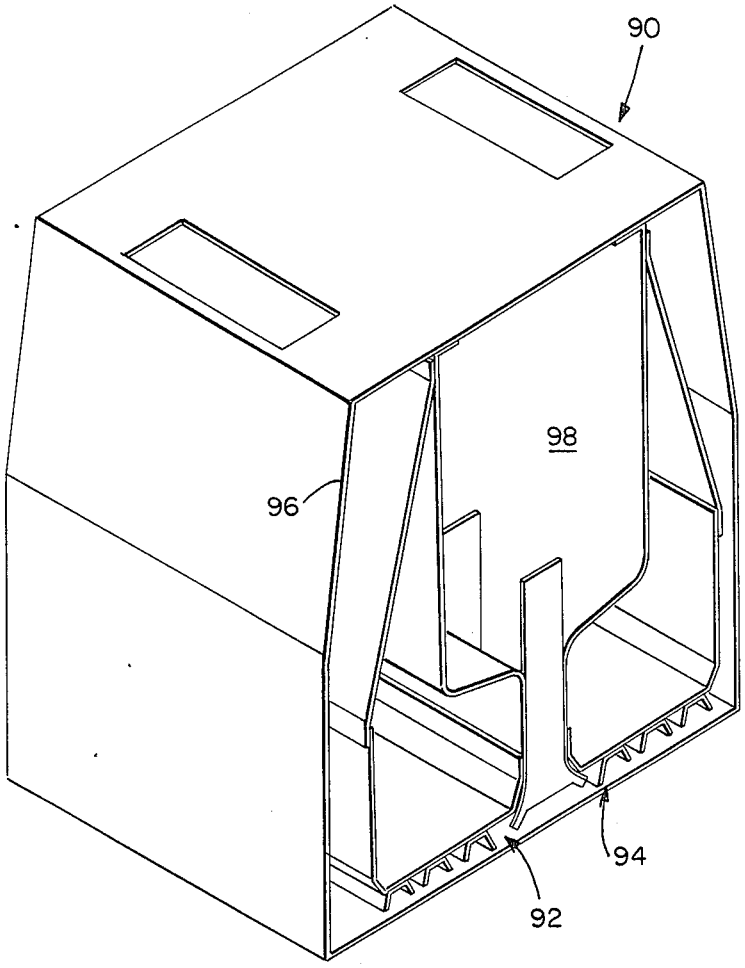

FIG. 9 is a perspective view with front fact partially cut away, view of a dual-drier system wherein the air supply for both driers enters from a central plenum.

Figure 10:
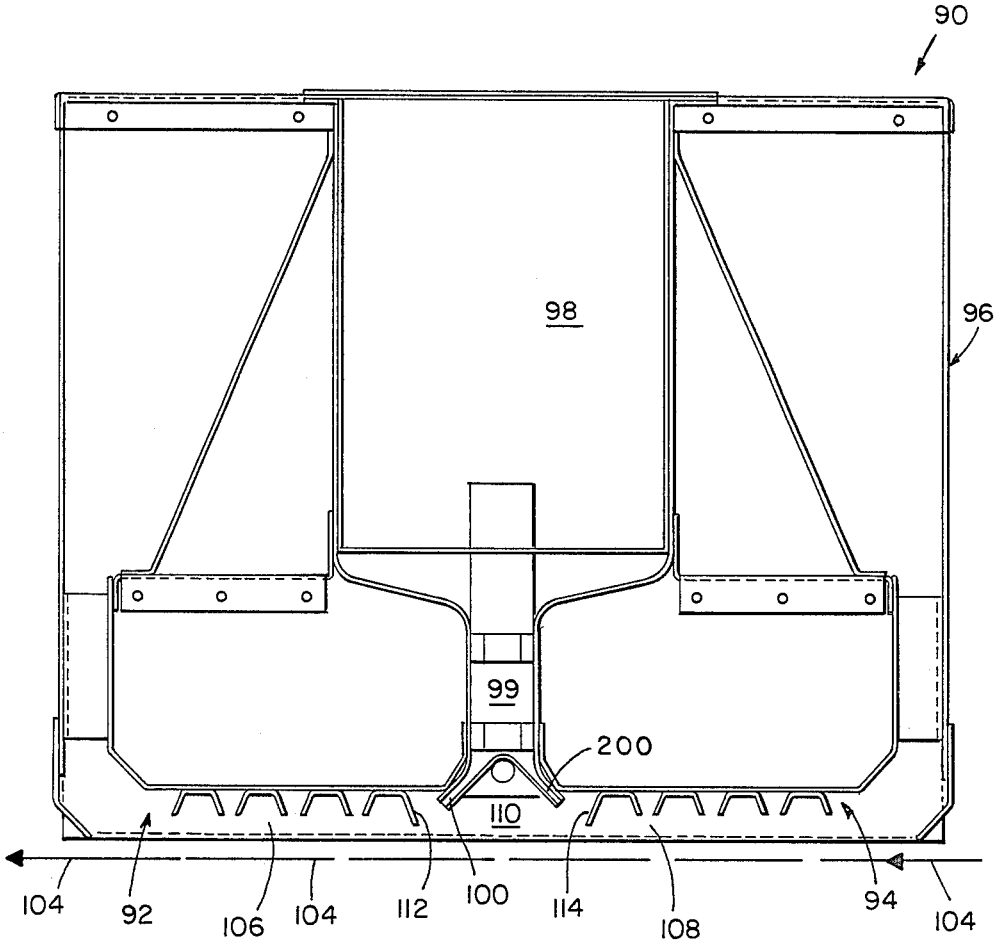

FIG. 10 is a front elevational view of the drier of FIG. 9, showing the extended leg, most proximate the gas inlet, of the vortex-inducing baffles.

Figure 1:
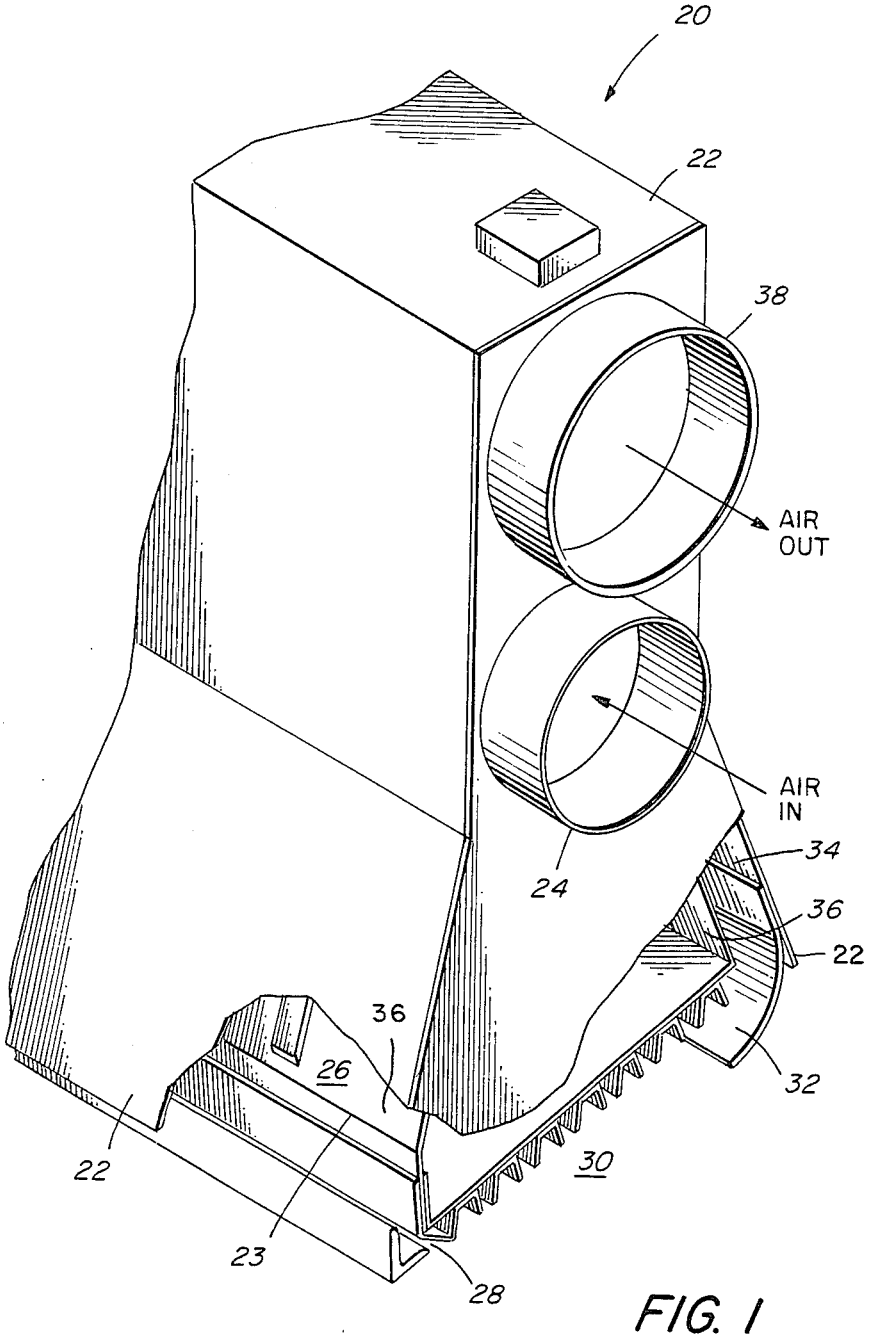
FIG. 1 is a perspective view of the apparatus of the invention; partially cut away to show air flow.
Figure 2:
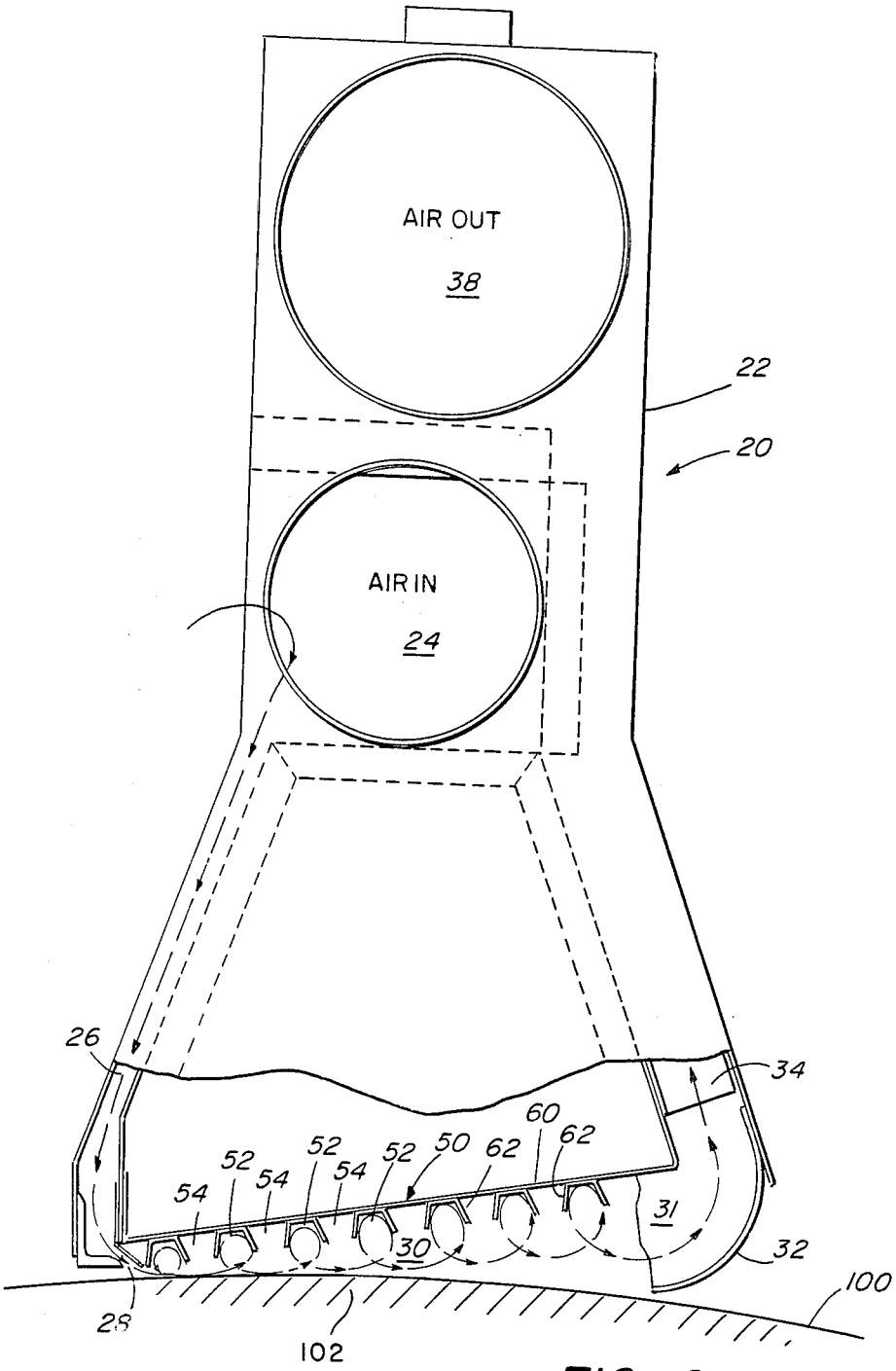
FIG. 2 is an elevation of the invention, partly cut away to show the vortex-drying baffle plate function over a surface being dried.

FIGS. 1 and 2 illustrate a drier apparatus 20 comprising, within a single housing 22, an inlet conduit system for admitting drying air through ducts inlet 24, thence down a laterally-positioned channel 26 between housing 22 and interior wall 36, and through an elongate slot or "nozzle" 28 at an angle to a web surface 100. Hence, the drying air (as best seen in FIG. 2) is directed laterally, through a drying zone 30 beneath the apparatus 20, into an outlet conduit system for "spent" drying gas. Spent drying gas is defined herein as gas which has been used in the drying apparatus, has picked up volatiles from the surface to be dried, and which is to be exhausted from the drying zone.

The outlet conduit system comprises a gas deflector or guide member 32 depending from housing 22, another conduit 34 which is generally defined by the exterior wall of the housing 22 and an interior outlet conduit wall 36, and an outlet conduit 38 from which such gas leaves the illustrated drier. The gas deflector guide 32 forms the bottom perimeter of an entry passage 31 to admit spent drying gas from drying zone 30 into the outlet conduit system. In the illustrated use, drier apparatus 20 is adapted to be positioned closely to a continuously-moving surface (an inked web 100 carried on a flexographic printing roll 102) which is to be continually dried as web 100 moves relative to the drier 20. The particular novelty of the process relates to how the novel structure of the apparatus processes the air as it enters and transverses drying zone 30 between web 100 and a baffle plate 50, and leaves the drying zone 30.

The lower perimeter of the drying apparatus is a baffle plate 50 which is mounted on housing 22. Baffle plate 50 comprises, mounted along its surface, a series of primary grooves or channels 52. The baffle plate 50 is slanted upwardly at an angle of about 12 degrees (relative to an imaginary line drawn between the inlet slot 28 and the lower portion of deflector shield 32) as it proceeds from its leftmost position on FIG. 2 adjacent gas inlet slot 28 to its rightmost position nearer deflector 32 where it forms the upper perimeter of the passage 31 through which drying as it enters the outlet conduit system. Depending on the application, inlet velocities are conveniently between 5,000 and 20,000 feet per minute. The illustrated process utilizes about 6,000 feet per minute through 0.08-inch wide slot 28.

Baffle plate 50 is constructed of a base plate 60 to which are attached a series of inverted half-hexagonal-shaped channel members 62 which form the grooves 52. These grooves 52, it will be seen, form means to aid in the formation of vortices in the flow of drying gas as it moves through the drier.

In the drier of FIGS. 1 and 2 it is seen that the construction results in the formation of another set of grooves or channels 54 which are formed by the spaced half-hexagonal channel member 62. These secondary grooves 54, which have smaller openings to the main portion of the drying zone, have been found to prevent interference between consecutive vortices, i.e. facilitate formation of an improved vortex pattern across the series of primary channels or grooves 52.

When there are secondary channels, e.g. as shown in FIG. 2, the mouths thereof are desirably smaller than the mouths of the principal channels such that when vortices are visualized within the principal channels, the distance between adjacent principal channels is about one-half the diameter of the vortices.

The absolute size of the channels will vary with the size of equipment and gas volume being handled. The apparatus of FIGS. 2 and 3 is shown roughly to a $\frac{1}{3}$ scale (linear) and is conveniently utilized to handle a volume of 250 cubic feet per minute of inlet drying gas per minute when the drier is 38 inches deep in the direction parallel to the length of grooves 52 and 54.

FIG. 2 shows the apparatus of the invention brought into close proximity to a surface 100 which has a freshly inked coating. In practice, the drier 20 is brought as close as is practical to the surface to minimize the tendency of any gas to pass through the gas between surface 100 and deflector 32. The gap, in all cases, will be matched to air handling equipment. This system allows considerably wider gaps because the loss of kinetic energy results in relatively quiescent air approaching the deflector 32. Such air has a much reduced tendency for leaving the drier. Such wider gaps are often advantageous. For example, they can reduce ink-splash problems—spilled ink coating the apparatus.

Air admitted inwardly and downwardly through an 0.08-inch wide slot 28 at an angle of about 35° is caused to hit the surface to be dried and, in substantial part, form a vortex as shown, along the entire length of leftmost channel 52. The air, once swirling, continues to take this action forming vortices in subsequent channels 52. The apparatus is best designed such that the tangential line along the bottom of idealized vortices is probably from about 8 to 15 degrees. An angle of about 11 degrees being optimum for most applications.

The drying gas is extremely well mixed. Stratification is avoided near the surface being dried. Moreover, the mixing action is also accomplished with the loss of a great deal of the kinetic energy of the incoming gas, so that as the gas approaches the leftmost side of the drier and prepares to exit, it has a relatively uniform and low velocity and relatively little tendency for any velocity transients in the drying air to escape through the space between deflector 32 and the surface being dried. This greatly reduces the amount of suction, or air-pumping energy, that must be applied to the gas outlet side of the system to avoid leakage of drying air into the environment of the drier. Alternately, it can allow a somewhat greater spacing between the apparatus and the surface being dried. This can be important in reducing contamination of the apparatus by process liquids in some cases. Typically, the amount of power needed to exhaust the spent drying air will be a small fraction of power required to exhaust equivalent amounts of air from drying systems of the prior act. Over and above this power saving feature, it is to be emphasized that the quantity of drying done by a given volume of air will usually be greater because of the efficient and orderly mixing of the air and maintain optimum air flow over the drying surface as the air proceeds through the drying zone.

Reference is made to a group of other baffle plate modes which are useful in achieving a series of vortices according to the invention.

Thus, FIG. 3 shows a baffle plate 50 wherein spaced sinusoidal, vortex-inducing channels 52*a* are separated by relatively flat intervening baffle wall sections 150.

FIG. 4 shows a baffle plate 50*b* of sinusoidal configuration wherein the sequential grooves 52*b* are shown to increase in size as they progress from left to right along the baffle plate.

FIG. 5 illustrates a baffle plate 50*c* which is similar to that shown in FIG. 2 exception for the absence of any secondary grooves between spaced grows 52*c*.

FIG. 6 illustrates a baffle plate 50*d* wherein secondary grooves 54*d* do occur between semi-circular channels 52*d*.

FIG. 7 illustrates still another baffle plate 50*e* with vortex-inducing channels 52*e*.

It will be seen that primary vortex-inducing channels are generally wider at their mouth and narrower as their depth, (i.e. distance from the drying zone) increases.

It is desirable to maintain certain design parameters in sizing and spacing the vortex inducing channels of the invention. Thus the apparatus is best designed, as seen schematically in FIG. 8, such that the angle, A, between the surface 200 to be dried and the bottom tangent line B along circles 210, really idealized vortices, inscribed in the principal grooves 220, does not exceed 15 angular degrees. In general, the design can be modified to accomodate application to curved surfaces being dried. One way of doing this and maintaining a straight baffle member 230 is to provide slightly larger channels as one moves to the rightward along member 230.

The ratio of depth of the channels to width of the channels is conveniently within a range of about 2:5 to 4:5. The length of the channels is not particularly critical. Any limitation is more closely related to the ability of the inlet to achieve proper distribution to the inlet slot. Channel lengths from a few inches to 30 or 60 inches, or even longer, are entirely suitable. There is no strict requirement that the channels be absolutely straight or continuous as long as the vortex-forming characteristics, and advantages achieved thereby, are not substantially impaired.

Referring to FIGS. 9 and 10, it is seen that a drier assembly 90 compries two drier units 92 and 94 within a housing 96. Units 92 and 94 are on each side of a centrally-located inlet gas plenum 98 which divides into, after passing into a lower plenum conduit 99, two drying-gas nozzles, or inlet ports, 100 and 200 for units 92 and 94 respectively. Because the drier is likely to be utilized in drying a non-supported portion of a web, the vortex-inducing baffle structure is substantially parallel with an unsupported substrate 104 passing under the drier assembly and forming with the driers, drying zones 106 and 108. This drying zone configuration maintains a more nearly uniform air pressure throughout the length of the drying zone and avoids a lifting of the web.

It has also been discovered that there is a tendency for the web to rise in zone 110 between the two inlets 100 and 102. It has been establihed that this is a result of a drop in pressure due to the asperating effect of the two drying gas streams emitted from nozzles 100 and 102. The problem has been substantially avoided by means of inlet-flow-inhibition shields 112 and 114. These shields provide a sufficient dimunition of the asperating effect to form means to maintain a higher relative pressure in zone 110. As indicated in the drawing, it is convenient and advantageous to have shields 112 and 114 formed by extending that perimeter of the vortex-inducing baffles proximate to the nozzle.

It is also to be understood that the following claims are intended to cover all of the generic and specific features of the invention herein described and all statements of the scope of the invention which might be said to fall therebetween.

What is claimed is:

1. An apparatus of the type used to provide process gas across a surface to be treated with said gas, said apparatus comprising:

(a) a flow-directing baffle along the lower perimeter of said apparatus;

(b) elongate inlet conduit means at a side of said baffle to introduce a stream of high velocity gas between said flow-directing baffle and said surface to be treated;

(c) said flow-directing baffle comprising a series of primary grooves therein, said primary grooves being arranged generally perpendicular to direction of flow of said process gas from said elongate conduit;

(d) and wherein said series of said primary grooves form means, when said apparatus is brought into close proximity with a surface to be treated, to form a series of vortices in said process gas as it transverses across said surface in a process zone formed between said surface and said flow directing baffle; and (e) suction means to remove spent process gas from said apparatus.

2. Apparatus as defined in claim 1 wherein a second conduit for said suction means is incorporated into a common housing with said elongate conduit means said second conduit forming means to remove spent process gas from said apparatus.

3. Apparatus as defined in claim 1 wherein the cross-sectional area of each said primary grooves in said series is positioned at an incrementally greater vertical distance from said elongate conduit as it is positioned incrementally further from said elongated conduit along said flow-directing baffle.

4. Apparatus as defined in claim 1 comprising from two to eight said primary grooves along said baffle.

5. Apparatus as defined in claim 3 comprising from two to eight said primary grooves along said baffle.

6. Apparatus as defined in claim 1 wherein said grooves number at least four.

7. Apparatus as defined in claim 1 wherein said baffle forms means to direct said spent process gas into said suction means, said baffle being positioned substantially parallel to said inlet conduit, and wherein there is an imaginary plane connecting the lower extremity of said baffle structure and said inlet conduit and wherein said baffle is arranged from an angle of divergence within a range of about 8 to 15 angular degrees from said imaginary plane.

8. Apparatus as defined in claim 7 wherein said angle of divergence is about 11°.

9. Apparatus as defined in claims 2, 6, 7 or 8 comprising secondary grooves between said primary grooves, said secondary grooves having smaller mouths to said zone than said primary groove.

10. Apparatus as defined in claim 1 comprising secondary grooves between said primary grooves, said secondary grooves having smaller mouths open to said process zone than do said primary grooves.

11. Apparatus as defined in claims 1, 3, 7, 8, or 10 wherein said apparatus is a drying apparatus, said process zone has a lower boundary formed by a wet surface to be treated.

12. Apparatus as defined in claim 3 or 4 wherein said inlet conduit is means to direct said air onto said surface to be treated at an angle of about 35 degrees.

13. An assembly suitable for providing process gas across a web to be treated with said gas said assembly containing apparatus as defined in claim 1 wherein said apparatus is so constructed that said flow-directing baffle with said grooves therein is so configured that, when it is used to form a said process zone with a flat web, it does not diverge from said web but is substantially parallel thereto, thereby forming a process zone which, but for the structure of said grooves, has an approximately constant cross section between said inlet and said suction means.

14. An assembly as defined in claim 13 wherein said number of grooves number at least four.

15. An assembly suitable for providing process gas across a web to be treated with said gas, said assembly containing two of said apparatus as defined in claim 1 with a centrally positioned nozzle assembly having a nozzle to provide a stream of said process gas, when said assembly is brought into close proximity with said web, to a process zone formed between said apparatus and said web, at least one of said apparatus comprising an inlet-flow-inhibiting shield placed between a said inlet nozzle and a said process zone, said shield forming means to decrease the pressure differential between (a) said process zone and (b) the space between said web and said nozzle assembly, thereby avoiding the sucking up of web which in said space towards said nozzle assembly.

16. Apparatus as defined in claim 15 wherein said shield is an extension of the structure of a said primary groove of said flow-directing baffle.

17. Apparatus as defined in claims 15 or 16 wherein said grooves of each said apparatus number at least four.

18. A process of drying a continuous moving coated surface comprising the steps of (a) directing, through a relatively narrow elongate inlet slot, a stream of drying gas to flow through a drying zone of expanding cross-section formed between said surface to be dried and a gas-restraining baffle spaced above said surface;

(b) removing said stream of drying gas from a relatively wide end of said drying zone; and (c) enhancing mixing of said drying gas by formation of vortice in said drying gas providing a series of parallel channels in the surface of said baffle, said channels running generally parallel to said inlet slot and generally perpendicular to said stream of drying gas by formation of a series of vortices therein as said gas moves through said drying zone said enhanced mixing being achieved by providing a series of parallel channels in the surface of said baffle which run generally perpendicular to said stream of drying gas.

19. A process as defined in claim 18 wherein said drying gas is initially directed from said inlet slot against said surface to be dried and thence deflected upwardly against said baffle.

20. A process as defined in claim 18 wherein velocity across said drying zone is decreased by about an order of magnitude before leaving said drying zone.

21. A process as defined in claim 18 wherein said air moves across said drying zone counter current to movement of said surface being dried.

22. A process as defined in claim 18 wherein said angle is 11 degrees.

23. A process as defined in claim 20 comprising use of secondary channels between said parallel channels to enhance a vortex pattern in said drying zone.

24. A process as defined in claim 18 wherein difficult of said drying gas between said inlet slot and said relatively wide end of said drying zone is achieved by an increase in the cross section of said zone, between said inlet slot and said wide end, being defined by an angle of between 8 and 15 angular degrees between a tangent line drawn along the bottom of circles inscribed in the cross section of said grooves and said surface to be dried, said baffle and said surface to be dried.

25. A process as defined in claim 24 comprising use of secondary channels between said parallel channels to enhance a vortex pattern in said drying zone.

26. A process as defined in claim 24 wherein said velocity across said drying zone is decreased by about an order of magnitude before leaving said drying zone.

* * * * *